US007997935B2

(12) United States Patent
Lai

(10) Patent No.: US 7,997,935 B2
(45) Date of Patent: Aug. 16, 2011

(54) CARD CONNECTOR CAPABLE OF SCRAPING

(75) Inventor: Yaw-Huey Lai, Taipei County (TW)

(73) Assignee: TAI-SOL Electronics Co., Ltd., Taipei (TW)

( * ) Notice: Subject to any disclaimer, the term of this patent is extended or adjusted under 35 U.S.C. 154(b) by 39 days.

(21) Appl. No.: 12/588,429

(22) Filed: Oct. 15, 2009

(65) Prior Publication Data

US 2011/0045703 A1 Feb. 24, 2011

(30) Foreign Application Priority Data

Aug. 18, 2009 (TW) ..... 98215218 U

(51) Int. Cl.
*H01R 24/00* (2006.01)

(52) U.S. Cl. ..... 439/630

(58) Field of Classification Search ..... 439/629, 439/630, 59, 188, 489
See application file for complete search history.

(56) References Cited

U.S. PATENT DOCUMENTS

| | | | | |
|---|---|---|---|---|
| 6,431,893 | B1 * | 8/2002 | Chang et al. | 439/188 |
| 6,899,557 | B2 * | 5/2005 | Hirata | 439/188 |
| 2005/0059281 | A1 * | 3/2005 | Bricaud et al. | 439/188 |
| 2007/0287335 | A1 * | 12/2007 | Ma | 439/637 |

FOREIGN PATENT DOCUMENTS

| | | |
|---|---|---|
| TW | M267600 | 6/2005 |

* cited by examiner

*Primary Examiner* — Alexander Gilman
(74) *Attorney, Agent, or Firm* — Bacon & Thomas, PLLC

(57) ABSTRACT

A card connector composed of a base frame, at least one terminal set, and a detective terminal. While a card enters a card space inside of the base frame, it works on and forces a working portion of a working springy piece of the detective terminal toward a passive springy piece of the detective terminal for electric conduction with the same. When the working springy piece is moved to contact the passive springy piece, a scraping portion of the working springy piece contacts and scraps a contact portion of the passive springy piece to force the passive springy piece to deform; meanwhile, the resilience generated by the deformation of the passive springy piece keeps it in contact with the working springy piece. In this way, during the contact, the oxide or stain can be scraped off f to make the contact more perfect to secure the detective accuracy.

10 Claims, 10 Drawing Sheets

CARD CONNECTOR CAPABLE OF SCRAPING

BACKGROUND OF THE INVENTION

1. Field of the Invention

The present invention relates generally to card connectors, and more particularly, to a card connector whose detective terminal is capable of scraping or rubbing.

2. Description of the Related Art

A general card connector includes two springy pieces formed at one side thereof and spaced from each other. After a memory card is inserted into the card connector, the card works on one of the springy pieces to push it inward for deformation of the springy piece and for contact with the other springy piece for short circuit, such that the entry of the card is detected. Taiwanese Patent No. M267600 disclosed a card connector having multiple springy pieces for detecting whether multiple kinds of the electronic cards are in position or write-protected or not. Specifically, the card connector includes a common terminal and a contact terminal which can be deformed to contact the common terminal for the aforesaid detection after the card is inserted to work on it.

Springy pieces, i.e. the contact and common terminals, are in contact with each other by their flat surfaces formed by bending themselves. However, the flat surfaces of the springy pieces are subject to generation of oxide or stain thereon which likely affects the electric conduction therebetween, such that the accuracy of the detection is probably reduced.

SUMMARY OF THE INVENTION

The primary objective of the present invention is to provide a card connector, whose two springy pieces of the detective terminal can scrap or rub each other while contacting each other to maintain electric conduction therebetween and to secure the detective accuracy.

The foregoing objective of the present invention is attained by the card connector composed of a base frame, at least one terminal set, and a detective terminal. The base frame includes an entrance formed at a front end thereof, and a card space formed therein for receiving an electronic card. The terminal set is composed of a plurality of terminals mounted to the base frame. The detective terminal is mounted to one side of the base frame, having a working springy piece and a passive springy piece spaced from the working springy piece. The working springy piece has a working portion interfering with the card space. While the card enters the card space, it works on and forces the working portion toward the passive springy piece for electric conduction with the same. The working springy piece has a contact part extending toward the passive springy piece and having a scraping portion. The passive springy piece has a contact portion corresponding to the contact part. When the working springy piece is moved to contact the passive springy piece, the scraping portion contacts and scraps the contact portion to force the passive springy piece to deform; meanwhile, the resilience generated by the deformation of the passive springy piece keeps it in contact with the working springy piece. In this way, during the contact, if the oxide or stain is generated, the two springy pieces can scrap it off to make the contact more perfect to secure the detective accuracy.

DETAILED DESCRIPTION OF PREFERRED EMBODIMENTS

Figure 1:
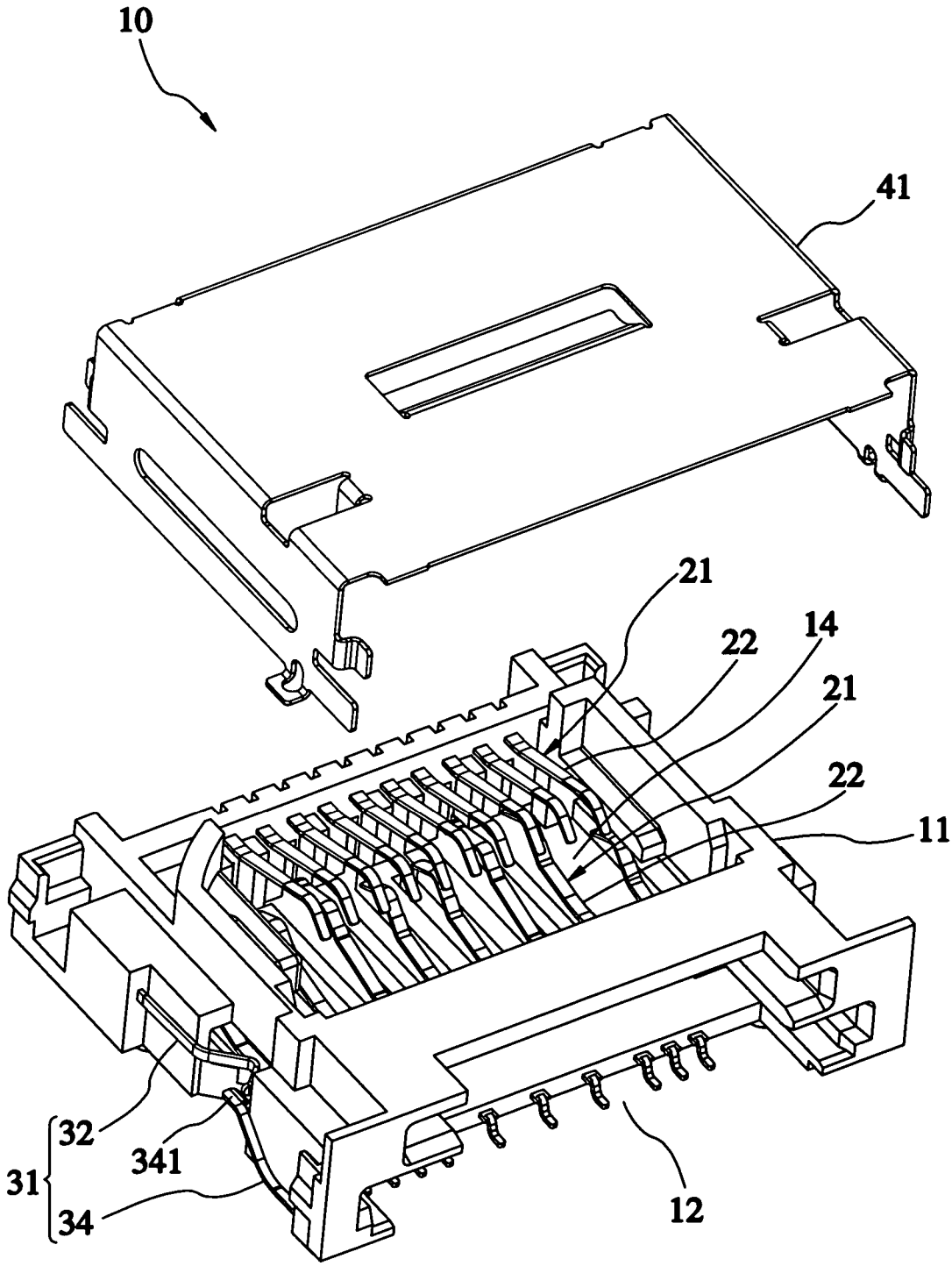
FIG. 1 is a perspective view of a first preferred embodiment of the present invention whose cover member is separated from the base frame.

Referring to FIGS. 1-4, a card connector 10 constructed according to a first preferred embodiment of the present invention is composed of a base frame 11, two terminal sets 21, a detective terminal 31, and a cover member 41.

Figure 2:
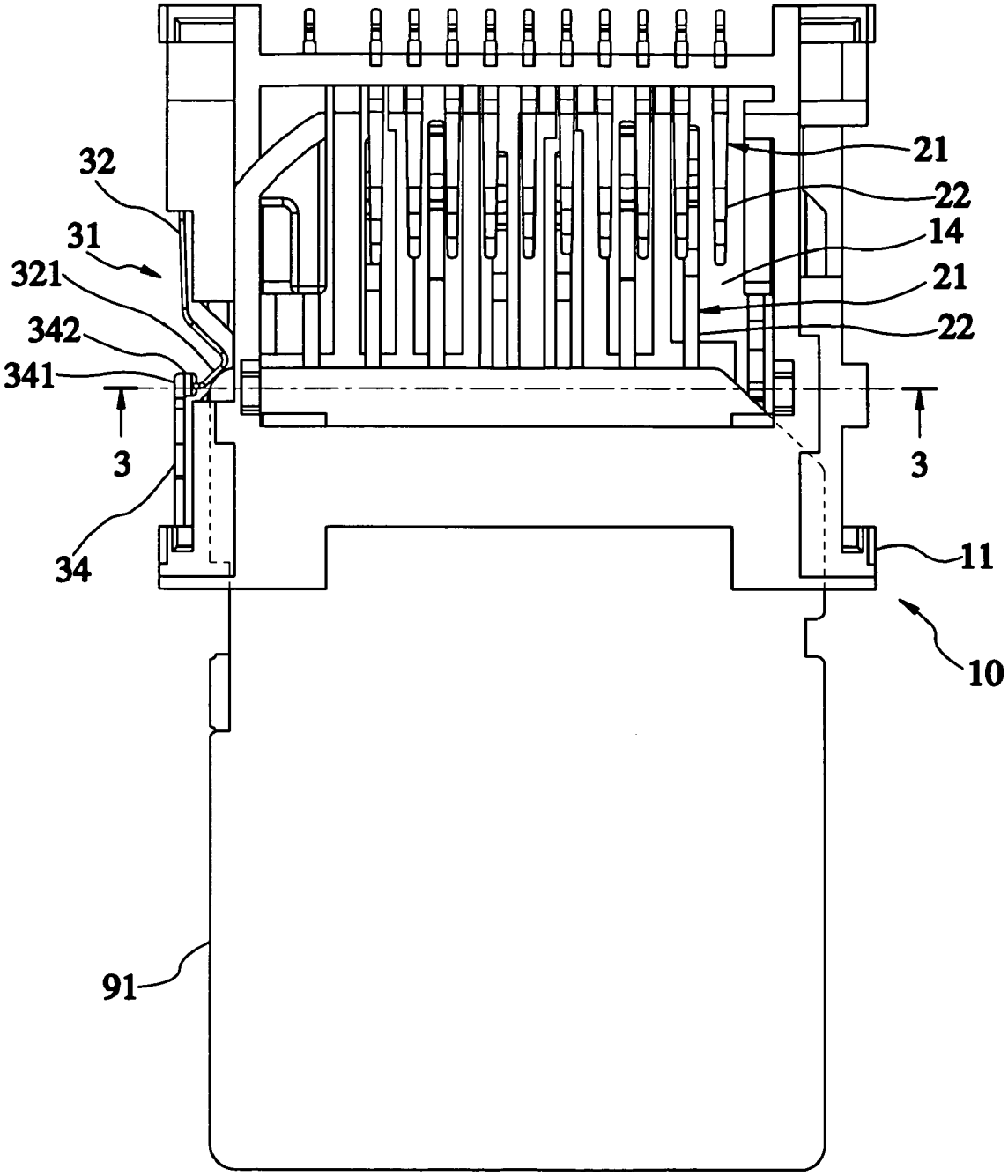
FIG. 2 is a top view of the first preferred embodiment of the present invention without the cover member.
Figure 3:
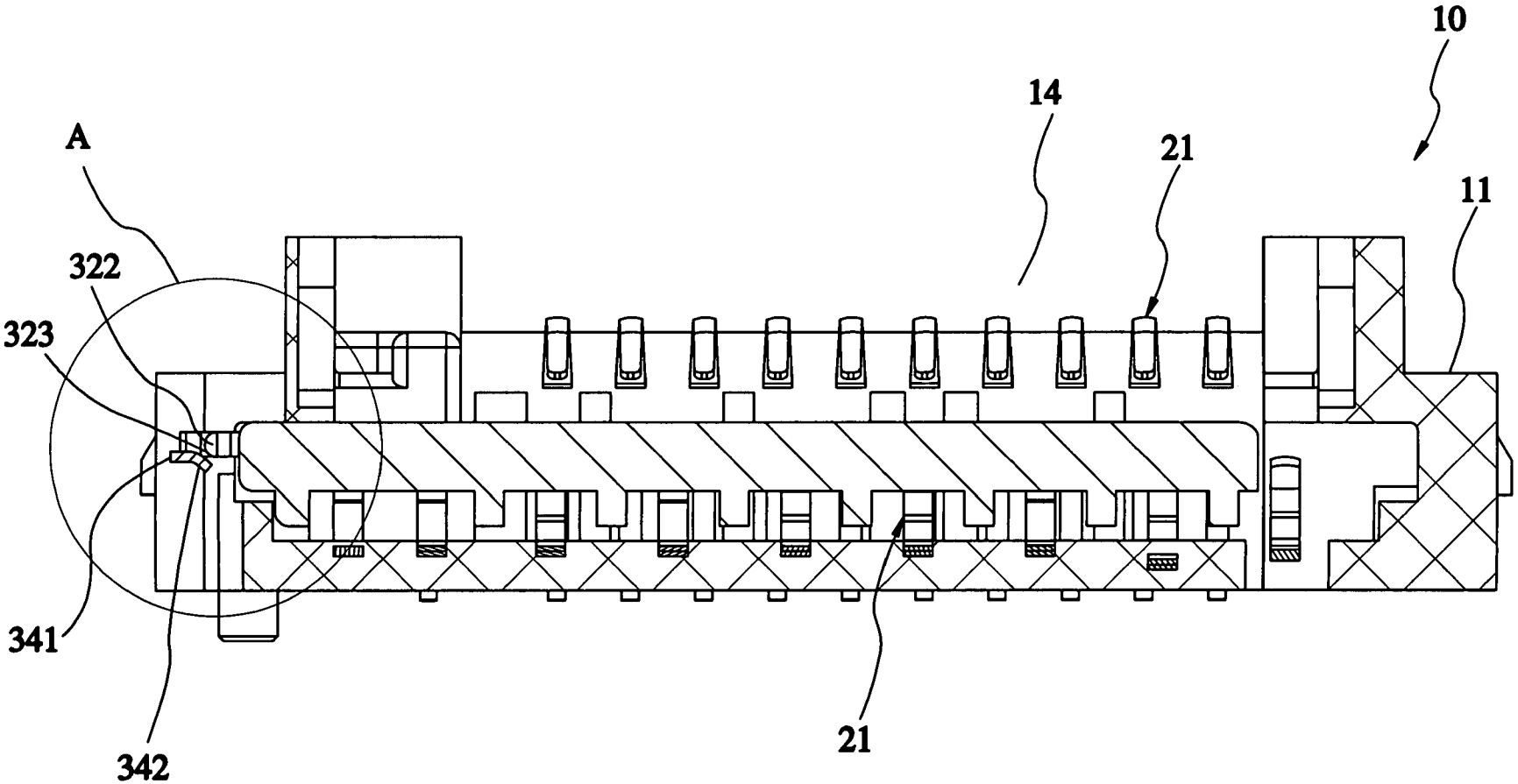
FIG. 3 is a sectional view taken along a line 3-3 indicated in FIG. 2.

The base frame 11 includes an entrance 12 formed at a front end thereof, and a card space 14 formed therein for receiving an electronic card 91, as shown in FIG. 2.

The two terminal sets 21 are mounted to the base frame 11, each having a plurality of terminals 22.

The detective terminal 31 is mounted to one side of the base frame 11, having a working springy piece 32 and a passive springy piece 34 spaced from the working springy piece 32 for a predetermined interval. Each of the working and passive springy pieces 32 and 34 has one end mounted to the base frame 11 by insert molding. The working springy piece 32 has a working portion 321 interfering with the card space 14. The working portion 321 is a bevel extending rearwards toward the card space 14 from the working springy piece 32. When the card 91 enters the card spaces 14, the card 91 works on the working portion 321 to force the working springy piece 32 to move outward toward the passive springy piece 34 for contact with the passive springy piece 34, reaching the detective purpose.

In addition, the working springy piece 32 further includes a contact part 322 extending toward the passive springy piece 34 therefrom. The contact part 322 has an arc-shaped scraping portion 323 formed at a distal end thereof. The passive springy piece 34 has a contact portion 341 formed at a location thereof corresponding the contact part 322. The contact portion 341 has a guiding face 342 located outside the contact part 322 and inclined and inwards downwards. When the working springy piece 32 is moved to contact the passive springy piece 34, the scraping portion 323 contacts the guiding face 342 to enable the contact part 322 to force downward deformation of the passive springy piece 34. In the meantime, the resilience of the passive springy piece 34 under the deformation maintains the contact of the working and passive springy pieces 32 and 34.

The cover member 41 is mounted on the base frame 11.

The operation manner of the first embodiment is set forth below.

Figure 4:
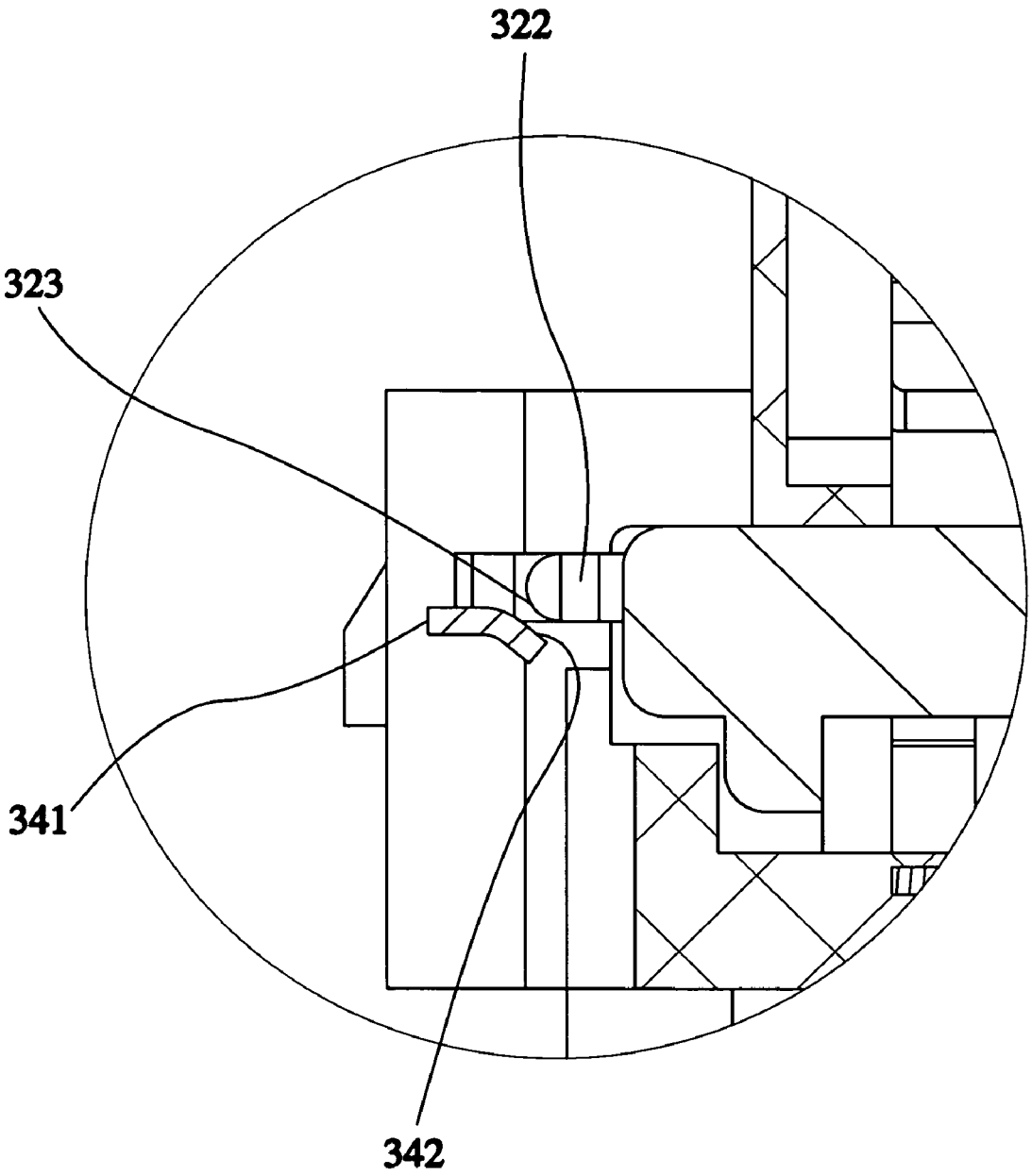
FIG. 4 is an enlarged view of a part A indicated in FIG. 3.
Figure 5:
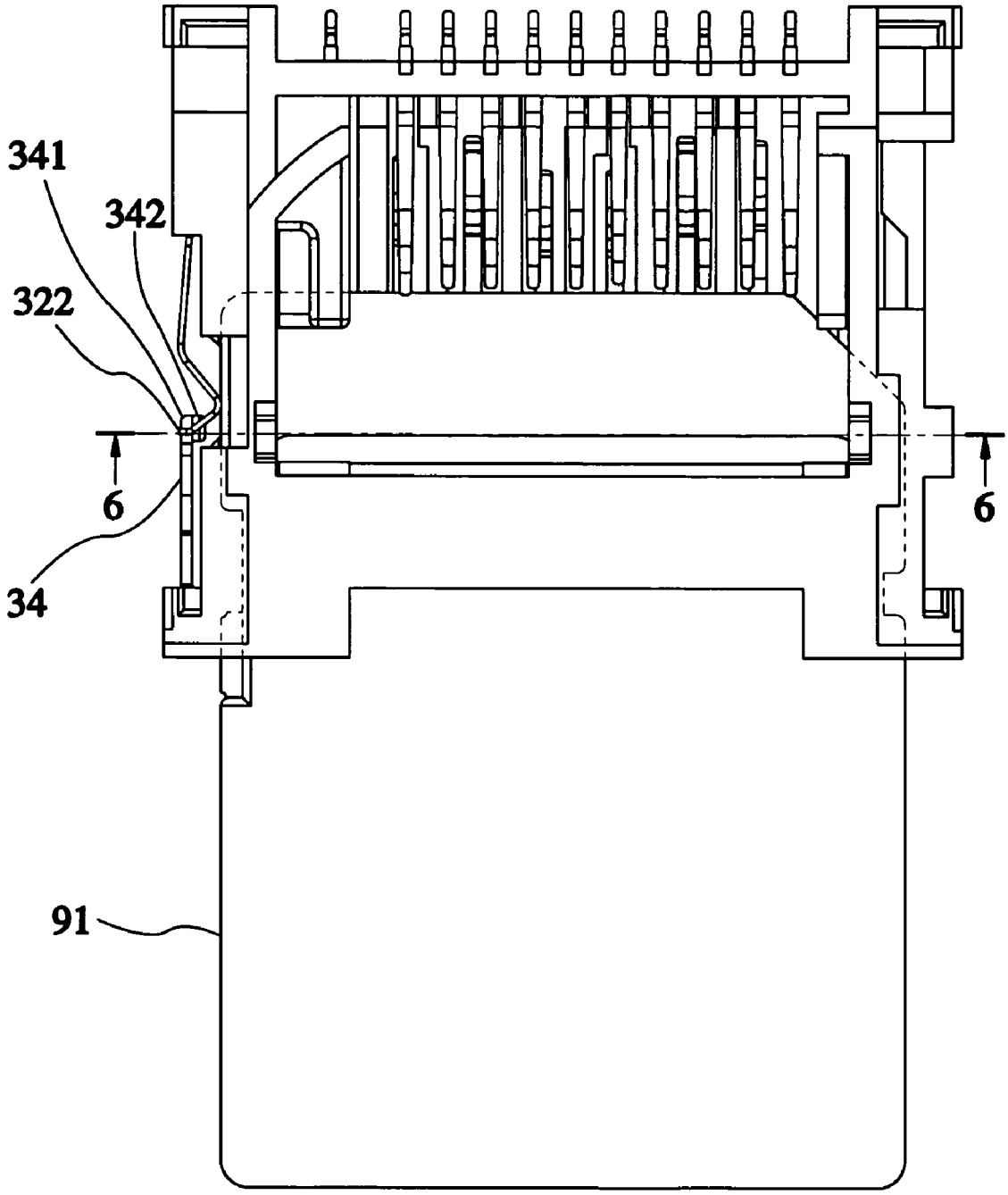
FIG. 5 is similar to FIG. 2, illustrating that an electronic card is inserted to pass through the working springy piece.
Figure 6:
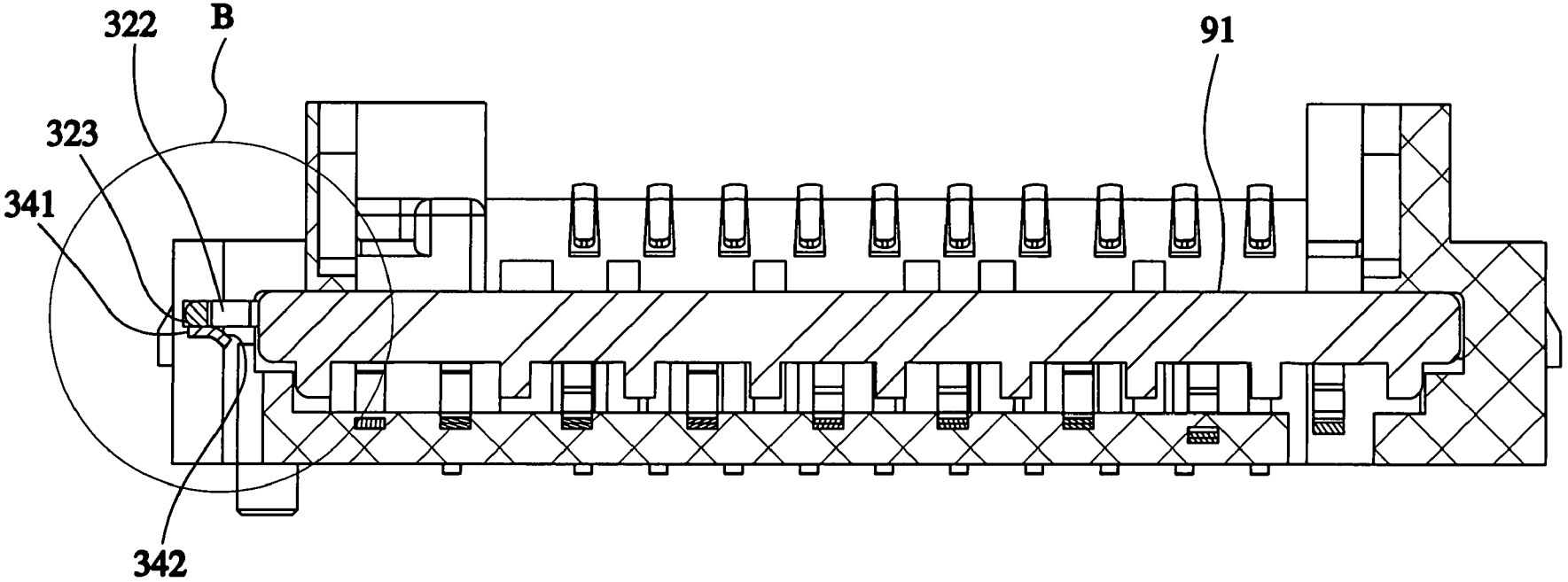
FIG. 6 is a sectional view taken along a line 6-6 indicated in FIG. 5.
Figure 7:
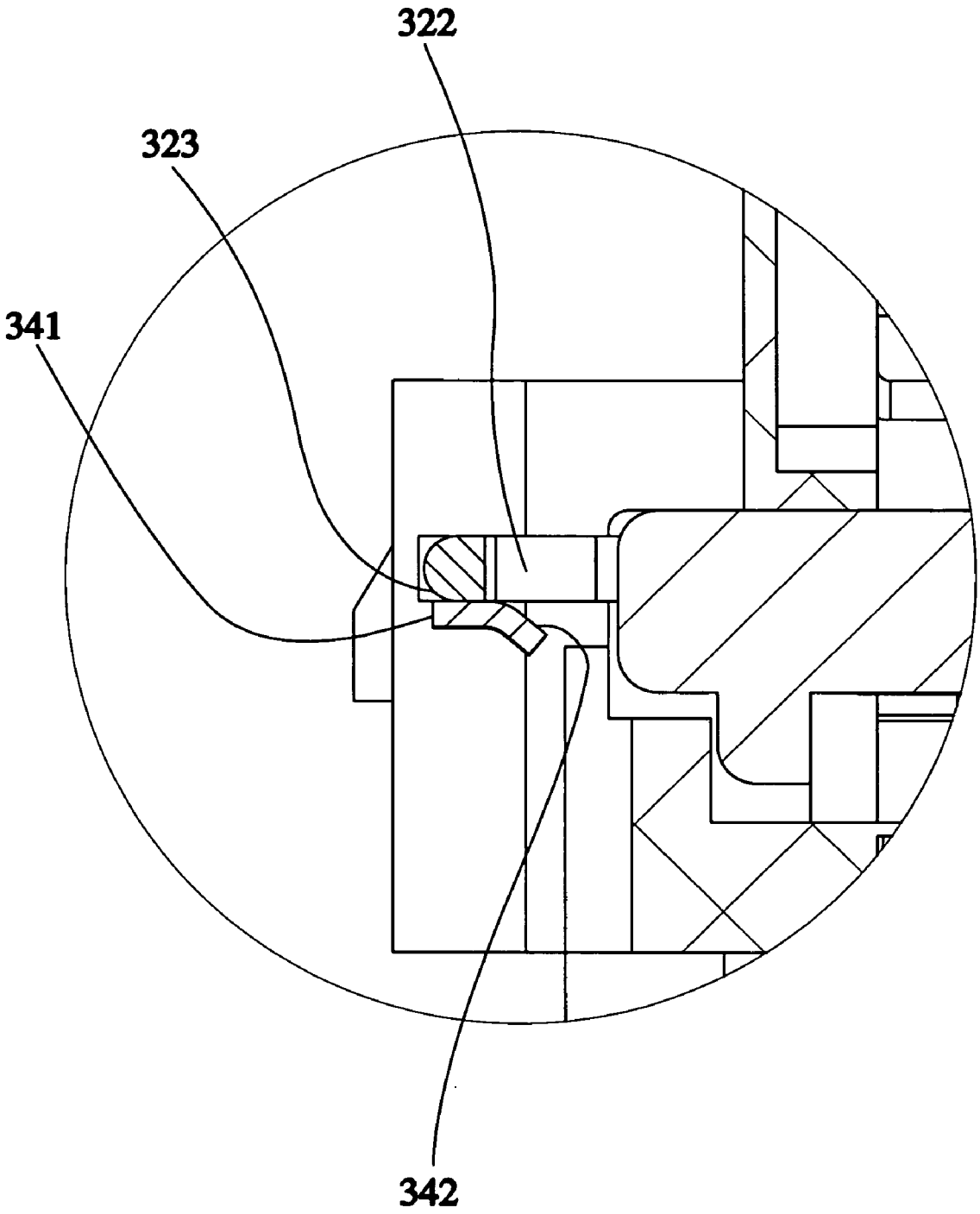
FIG. 7 is an enlarged view of a part B indicated in FIG. 6.

Before the card 91 is inserted into the card connector 10, the correlation between the working and passive springy pieces 32 and 34 is illustrated in FIGS. 1 and 4. Referring to FIG. 2 again, when the card 91 is inserted into the card connector 10 to work on the working portion 321, the working springy piece 32 is forced to move toward the passive springy piece 34. Next, as shown in FIGS. 5-7, when the card 91 continues to move forward, the scraping portion 323 of the contact part 322 contacts the guiding face 342 to force the passive springy piece 34 to deform downward. Finally, the contact portion 341 is pressed by and beneath the contact part 322 and the resilience of the passive springy piece 34 maintains their contact. In the process of the aforesaid contact and deformation, the scraping portion 323 slides on the guiding face 342 and the contact portion 341 to scrap or rub surfaces of the guiding portion 342 and the contact portion 341.

In the process of ejection of the card 91, the contact part 322 reverts to move away from the guiding face 342; meanwhile, the scraping portion 323 also slides on the guiding face 342 and the contact portion 341 to move away from the guiding face 342 to scrap or rub surfaces of the guiding face 342 and the contact portion 341 again. In this way, the scraping can eliminate oxide or stain produced on the surfaces of the guiding face 342 and the contact portion 341 and on the contact surface of the scraping portion 323 to enable the guiding face 342, the contact portion 341, and the scraping portion 323 to have good conductivity, further maintaining perfect contact therebetween and securing detective accuracy.

Figure 8:
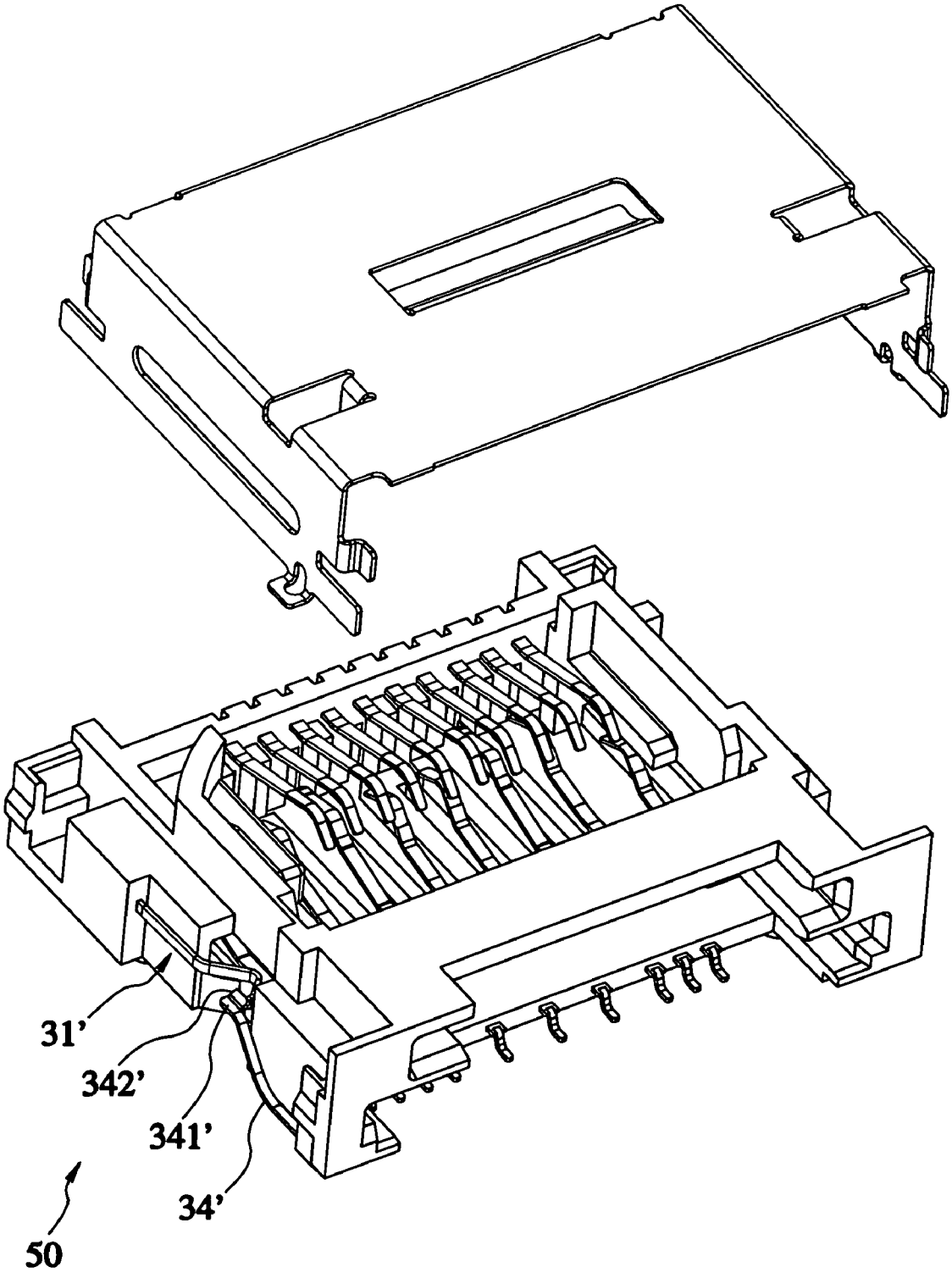
FIG. 8 is a perspective view of a second preferred embodiment of the present invention whose cover member is separated from the base frame.
Figure 9:
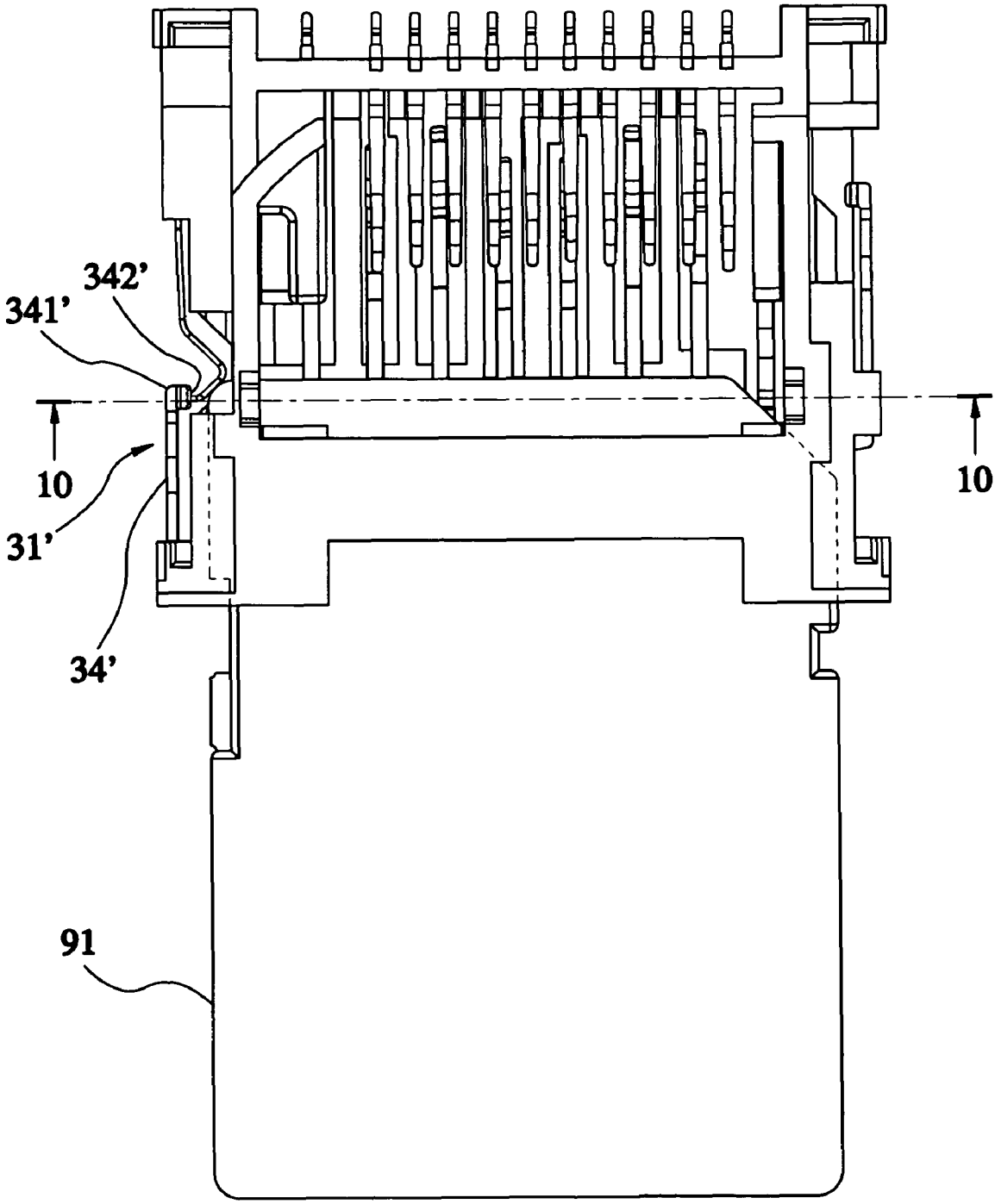
FIG. 9 is a top view of the second preferred embodiment of the present invention without the cover member.
Figure 10:
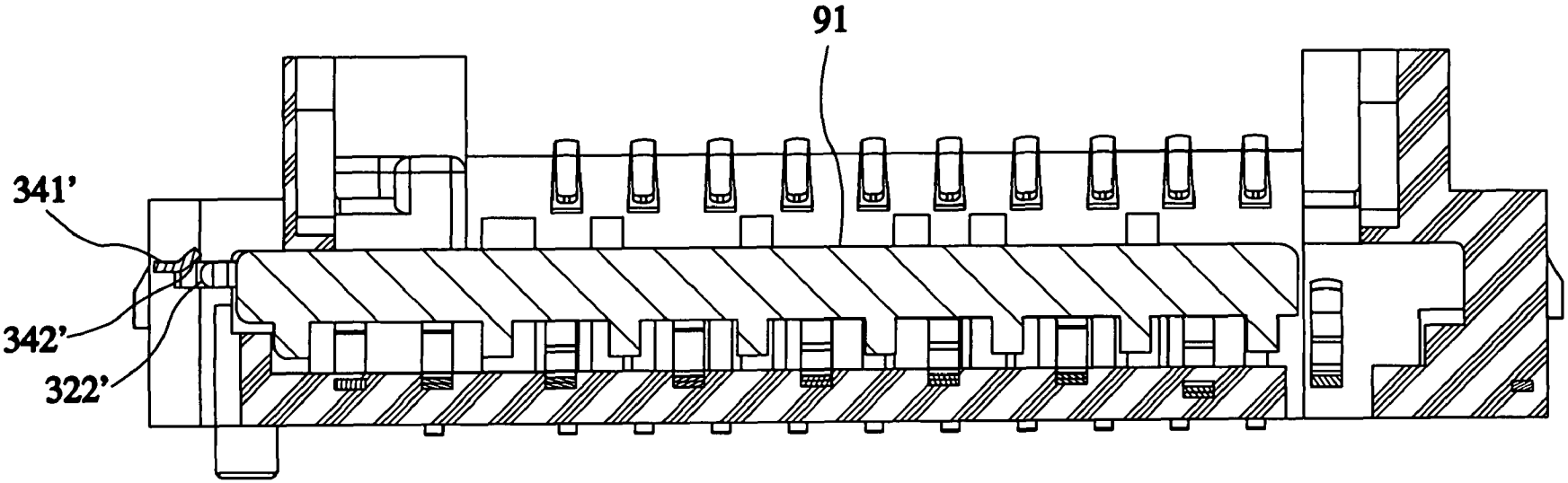
FIG. 10 is a sectional view taken along a line 10-10 indicated in FIG. 9.

Referring to FIGS. 8-10, a card connector 50 constructed according to a second preferred embodiment of the present invention is similar to that of the first embodiment, having the difference recited below.

The guiding face 342' of the contact portion 341' of the passive springy piece 34' is located outside the contact part 322' and inclined inward and upward. The deformation of the passive springy piece 34' is upward. When the card 91 is inserted into the card connector 50 of the second embodiment, the detective terminal 31' can do the same scraping effect as the first embodiment. Except the aforesaid difference, the structure and operational manner of the second embodiment are identical to those of the first embodiment, such that no more recitation is necessary.

In conclusion, the scraping portion of the contact part can scrap or rub the contact portion and the guiding face to remove the oxide or stain from the surfaces of the contact portion 341, the guiding face 342, and the scraping portion 323 to enable their contact surfaces to have good conductivity, keep their contacts perfect, and to secure the detective accuracy.

Although the present invention has been described with respect to specific preferred embodiments thereof, it is in no way limited to the specifics of the illustrated structures but changes and modifications may be made within the scope of the appended claims.

What is claimed is:

1. A card connector capable of scraping, comprising:

a base frame having an entrance formed at a front end thereof, the base frame having a card space formed therein for receiving an electronic card;

at least one terminal set composed of a plurality of terminals mounted to the base frame; and a detective terminal mounted to a side of the base frame and having a working springy piece and a passive springy piece spaced from the working springy piece, the working springy piece having a working portion which is a bevel extending rearward toward the card space and interfering with the card space; while the electronic card enters the card space, the card works on the working portion to force the working springy piece to move outward to contact the passive springy piece for electric conduction and thus for detection of entry of the card;

wherein the working springy piece further comprises a contact part extending toward the passive springy piece, the contact part having a scraping portion, the passive springy piece having a contact portion, and wherein the contact portion of the passive springy piece comprises a guiding face located outside the contact part and inclined inward and downward; the deformation of the passive springy piece is downward, the contact portion of the passive springy piece corresponding to the contact part of the working springy piece; while the working springy piece is moved to contact the passive springy piece, the scraping portion of the contact part contacts and scrapes the contact portion to force the passive springy piece to deform, whereby a resilience generated by the deformation of the passive springy piece maintains the contact of the working and passive springy pieces.

2. The card connector as defined in claim 1, wherein the scraping portion is arc-shaped.

3. The card connector as defined in claim 1, wherein the working springy piece has an end mounted to the base frame by inserting molding.

4. The card connector as defined in claim 1, wherein the passive springy piece has an end mounted to the base frame by insert molding.

5. The card connector as defined in claim 1 further comprising a cover member mounted on a base frame.

6. A card connector capable of scraping, comprising:

a base frame having an entrance formed at a front end thereof, the base frame having a card space formed therein for receiving an electronic card;

at least one terminal set composed of a plurality of terminals mounted to the base frame; and a detective terminal mounted to a side of the base frame and having a working springy piece and a passive springy piece spaced from the working springy piece, the working springy piece having a working portion which is a bevel extending rearward toward the card space and interfering with the card space; while the electronic card enters the card space, the card works on the working portion to force the working springy piece to move outward to contact the passive springy piece for electric conduction and thus for detection of entry of the card;

wherein the working springy piece further comprises a contact part extending toward the passive springy piece, the contact part having a scraping portion, the passive springy piece having a contact portion, and wherein the contact portion of the passive springy piece comprises a guiding face located outside the contact part and inclined inward and upward; the deformation of the passive springy piece is upward, the contact portion of the passive springy piece corresponding to the contact part of the working springy piece while the working springy piece is moved to contact the passive springy piece, the scraping portion of the contact part contacts and scraps the contact portion to force the passive springy piece to deform, whereby a resilience generated by the deformation of the passive springy piece maintains the contact of the working and passive springy pieces.

7. The card connector as defined in claim 6, wherein the scraping portion is arc-shaped.

8. The card connector as defined in claim 6, wherein the working springy piece has an end mounted to the base frame by inserting molding.

9. The card connector as defined in claim 6, wherein the passive springy piece has an end mounted to the base frame by insert molding.

10. The card connector as defined in claim 6, further comprising a cover member mounted on a base frame.

* * * * *